US008651980B2

(12) United States Patent
Jackson

(10) Patent No.: US 8,651,980 B2
(45) Date of Patent: Feb. 18, 2014

(54) COMBINATION TRAINING DEVICE FOR BALL SPORTS

(75) Inventor: Darvin Jackson, Naples, FL (US)

(73) Assignee: Darvin Jackson, Naples, FL (US)

( * ) Notice: Subject to any disclaimer, the term of this patent is extended or adjusted under 35 U.S.C. 154(b) by 128 days.

(21) Appl. No.: 13/312,338

(22) Filed: Dec. 6, 2011

(65) Prior Publication Data

US 2012/0149500 A1 Jun. 14, 2012

Related U.S. Application Data

(60) Provisional application No. 61/459,270, filed on Dec. 10, 2010.

(51) Int. Cl.
*A63B 69/00* (2006.01)

(52) U.S. Cl.
USPC ..... 473/435; 473/422; 473/454; 473/434; D21/705

(58) Field of Classification Search
USPC ..... 473/422, 434, 435, 197, 454–456, 476, 473/477, 478
See application file for complete search history.

(56) References Cited

U.S. PATENT DOCUMENTS

| | | | | | |
|---|---|---|---|---|---|
| 4,239,235 | A | * | 12/1980 | Torres | 473/434 |
| 4,417,728 | A | * | 11/1983 | Hay et al. | 473/435 |
| 5,002,274 | A | | 3/1991 | Bidema | |
| 5,088,740 | A | | 2/1992 | Peterson | |
| 5,333,856 | A | | 8/1994 | Gery | |
| 5,342,063 | A | * | 8/1994 | O'Brien et al. | 473/454 |
| 5,549,304 | A | * | 8/1996 | Davis | 273/400 |
| 5,564,711 | A | * | 10/1996 | Scheie | 273/400 |
| 5,573,240 | A | | 11/1996 | Humboldt | |
| 6,082,736 | A | * | 7/2000 | Barlow | 473/116 |
| D442,242 | S | * | 5/2001 | Rajacich | D21/705 |
| 6,357,750 | B1 | * | 3/2002 | Lievens | 273/395 |
| D462,733 | S | | 9/2002 | Smith | |
| 6,739,988 | B2 | * | 5/2004 | Jensen et al. | 473/435 |
| 7,462,115 | B2 | * | 12/2008 | Morrow | 473/454 |
| 7,468,009 | B1 | * | 12/2008 | Ball | 473/435 |
| 2004/0178585 | A1 | | 9/2004 | Cosenza | |
| 2008/0227571 | A1 | * | 9/2008 | McTavish et al. | 473/435 |
| 2009/0256344 | A1 | | 10/2009 | Mahoney | |
| 2012/0157239 | A1 | * | 6/2012 | Elpers | 473/416 |

* cited by examiner

*Primary Examiner* — Mitra Aryanpour

(74) *Attorney, Agent, or Firm* — McDonnell Boehnen Hulbert & Berghoff LLP

(57) ABSTRACT

A training device for ball sports includes a frame member which supports both an elastic surface for rebounding a ball, along with an inelastic surface which absorbs the kinetic energy of the ball and allows it to drop to the ground, which is designed as a combination apparatus that includes both a ball rebounding surface and a ball stopping surface, in order to provide a variety of training activities and which may be transported easily by a coach or an individual using it for practice.

13 Claims, 4 Drawing Sheets

COMBINATION TRAINING DEVICE FOR BALL SPORTS

BACKGROUND

This invention relates to training devices for sports involving balls which are thrown or projected in some other manner, such as baseball, tennis, lacrosse, and golf, among other things. The strong, patriotic tradition of baseball in the United States has led to the creation of various training devices for the particular benefit of baseball players. Baseball throwing, fielding and pitching training devices are desirable for a number of applications. Many coaches have a number of individuals to train simultaneously, and a training device can allow for more practice for the trainees without requiring constant one on one interaction with the coach. This not only increases efficiency, but prevents injury to the coach that can result from overworking certain muscle groups, such as a throwing arm. By incorporating the use of a training device into their routine, coaches can enable or provide the same amount of practice to their trainees without requiring undue physical exertion on the coach's part.

Even a coach who has teammates practice between each other still has use for these devices. Some players will have substantially more or less skill level than other players, and to meet their individual needs, the coach can incorporate a training device into the training to either help the trainee continue to excel beyond the level of the others, or to allow this individual to work at his or her own pace to reach the level of the other players.

These training devices are also desirable for players who do not have access to another individual with whom they can practice. Whether for financial reasons, or as a result of social or family circumstances, some individuals cannot utilize another individual in practice. Instead, they are required to use a training device to hone their skills.

There are many reasons for using pitching or throwing training devices. Two are particularly relevant to the present invention. First, players need to refine their accuracy, especially pitchers with regards to pitching. Pitchers can make or break a game for the entire team depending on a margin of error that could be less than an inch. Other players also need accuracy training, because the infielder who throws just a little too high over the head of the first baseman, or cannot field the ball properly, will not receive jovial cheers in the post game celebration.

Second, players need to build up the strength and endurance of their throwing arm, in order to throw farther and faster in the game. A pitcher with razor-sharp accuracy is virtually worthless if his arm gets tired after a few pitches. Likewise, the infielder who cannot throw the ball to the first baseman fast enough will never get the runner out, no matter how accurate his throw.

Thus, in baseball training, players need to utilize not only those exercises that generate accuracy, but also exercises that increase strength and endurance and improve reflexes. With regards to exercises that utilize training devices, some exercises require a device which will absorb the kinetic energy of a thrown ball, and simply let it fall to the ground without any rebound. For instance, a pitcher is vulnerable to a ricocheting ball in the moments after releasing the pitch, and it is desirable that, for the purposes of practice, the pitcher not be subject to the risk of getting knocked in the head with every returning pitch. Other exercises require a device to rebound the ball with substantially the same amount of force with which it was thrown.

Ball stopping training devices are known in the art. For example, see U.S. Pat. No. 5,573,240, issued to Geoffrey Humboldt on Nov. 12, 1996, for a baseball backstop for pitching training; U.S. Pat. No. 5,002,274, issued to Mark D. Bidema on Mar. 26, 1991, for a baseball batting practice device; U.S. Pat. No. 5,088,740, issued to Leroy L. Peterson on Feb. 18, 1992, for a practice backstop for ball playing sports; U.S. Pat. No. 5,333,8561, issued to Jonathan S. Gery on Aug. 2, 1994, for a pitching practice apparatus. None of the existing ball stopping devices include any mechanism whereby a ball will rebound to the person throwing it.

Ball rebounding training devices are also known in the art. For example, see U.S. Design Pat. No. D462, 733, issued to Christopher Smith on Sep. 10, 2002, for a baseball rebounder; U.S. Patent Application No. 2004/0178585 A1, by Anthony Consenza, on Mar. 14, 2003, for a strike zone for return throw pitching assemblies. The existing ball rebounding devices do not include any mechanism whereby the kinetic energy of a ball will be absorbed, allowing the ball to simply drop to the ground.

It is inconvenient to maintain two different devices for these various exercises. Not only will they require substantial space to use, even when placed immediately next to each other, they are also difficult to transport to such places as a practice field, or a game for warm-ups. Furthermore, the expense of maintaining two devices for all of the players on a team becomes too costly for a coach or team to bear. The cost may also be too high for an individual whose family is far enough below median income levels, thus preventing them from practicing necessary exercises at home on their own time.

SUMMARY OF THE INVENTION

The present invention provides a training device for ball sports that has both a rebounding mat and a stopping mat mounted to the same frame, which allows those using the invention to practice strength, endurance and/or reflex training, or to work on accuracy training, without having to use more than one device.

An optional feature of this invention provides a combination ball rebounding and stopping training device that is transportable for use in places other than a fixed location.

Another optional feature of one embodiment provides a single device which may be used for both ball rebounding exercises and ball stopping exercises, which has a smaller footprint than the two separate devices that would otherwise be required to practice these exercises.

The prior art does not include a combination device which has both a ball stopping mat and a ball rebounding mat. All of the prior art includes frames that have some kind of brace or other device that creates a substantial footprint that, in order to maintain the stability of the device, cannot be impinged upon by the frame of another device. None of the prior art devices have a mechanism whereby a ball stopping apparatus may be easily combined with a ball rebounding apparatus in the same footprint. Thus, if an individual using a device from the prior art wishes to alternate between exercises that involve a ball stopping mat and exercises that involve a ball rebounding mat, they must use two separate devices that have sizeable, independent footprints.

DETAILED DESCRIPTION OF THE PREFERRED EMBODIMENT

Figure 1:
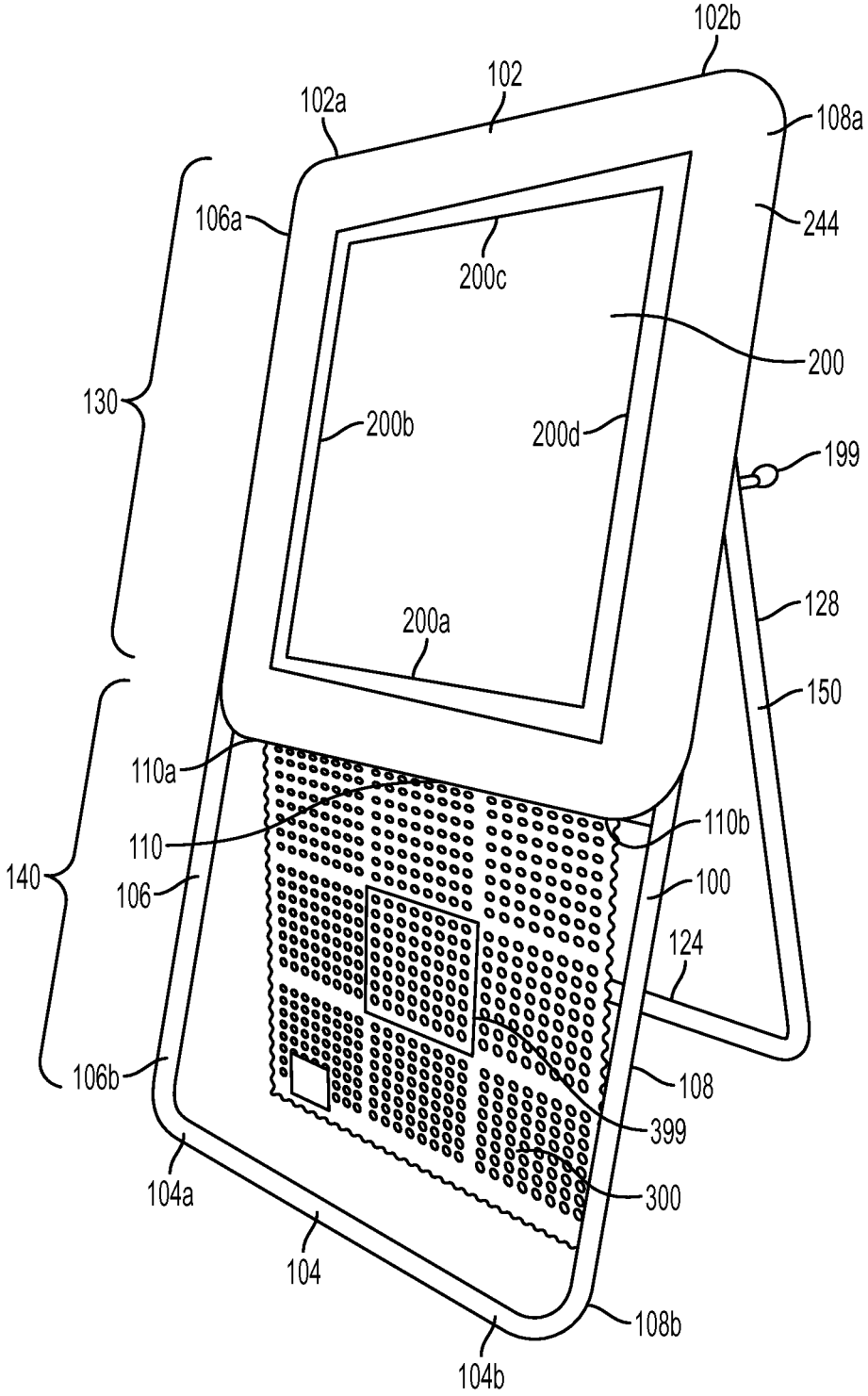
FIG. 1 is a front perspective view of a preferred embodiment of the pitching and throwing training device.
Figure 2:
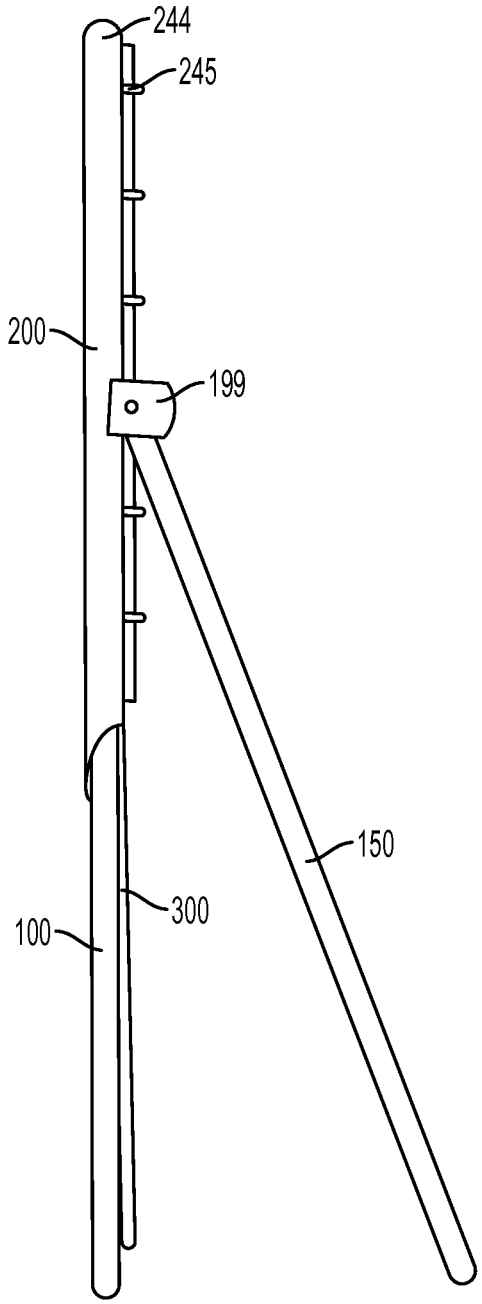
FIG. 2 is a side view of the pitching and throwing training device shown in FIG. 1.
Figure 3:
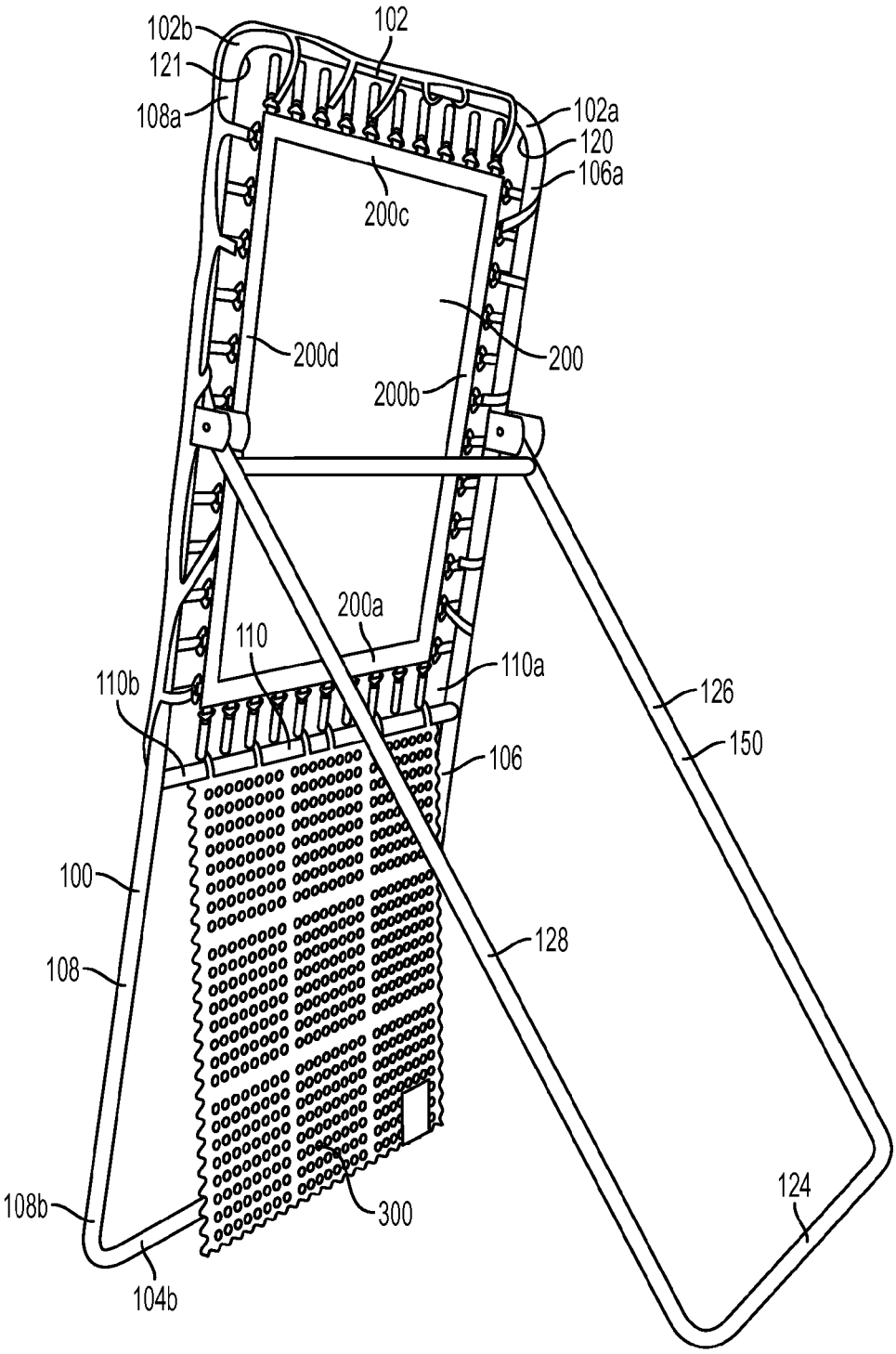
FIG. 3 is a rear perspective view of the pitching and throwing training device shown in FIG. 1.
Figure 4:
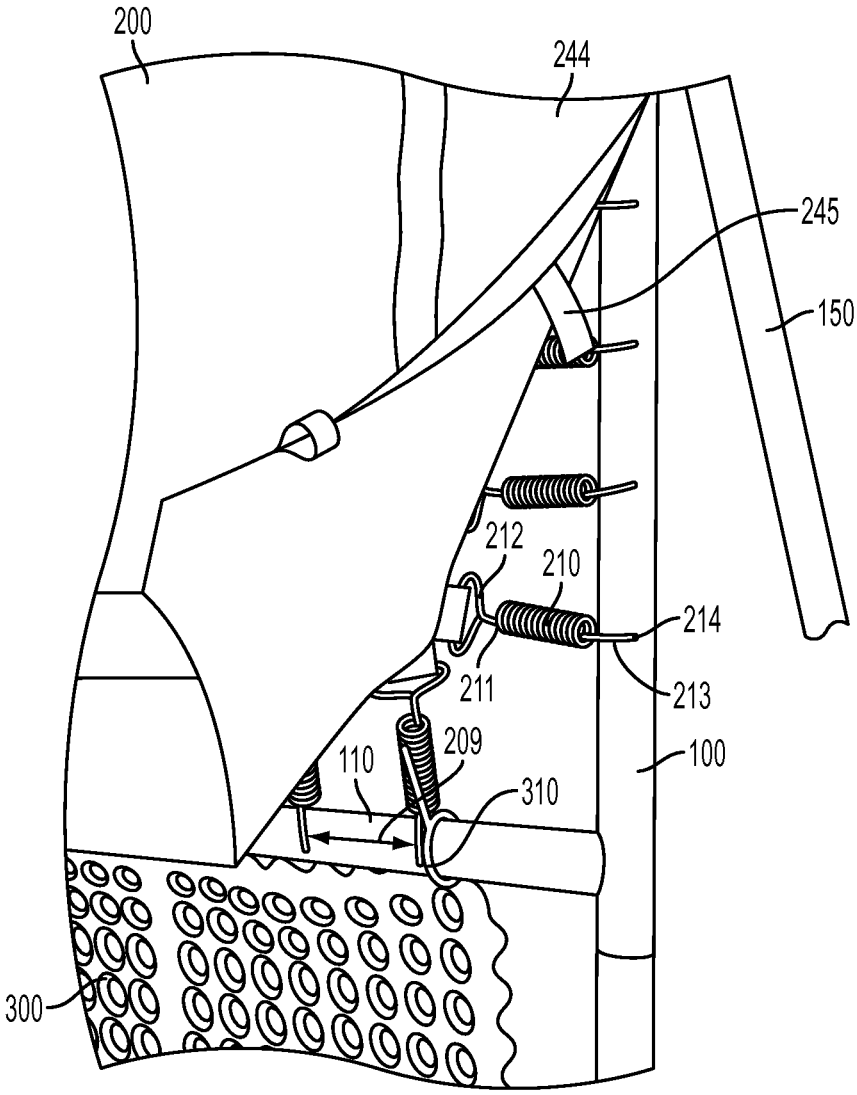
FIG. 4 is a front fragmentary view of the pitching and throwing training device shown in FIG. 1.

While it is possible to incorporate the teachings of the present invention into various devices in a number of ways, FIGS. 1-4 show a preferred embodiment of a training device for ball sports constructed according to the teachings of the present invention, with the understanding that the present disclosure is not intended to be limited to the specific constructions illustrated in the drawings.

The preferred embodiment shown in the figures has a rectangular frame 100 which is made of any suitable material, i.e. metal, wood or plastic. One preferred material for the frame is metal tubing, such as aluminum, which is both lightweight and strong. The frame 100 includes a horizontal top cross bar 102, made of metal tubing, having a left end 102*a* and a right end 102*b*. The frame 100 also includes left and right vertical supports 106 and 108 having upper ends 106*a*, 108*a* and lower ends 106*b*, 108*b*. The left and right vertical supports 106, 108, may consist of a series of separate sections of tubing that can be disassembled into shorter lengths for shipping. The upper ends 106*a*, 108*a* of the left and right vertical supports 106, 108 are connected to the left and right ends 102*a*, 102*b* of the horizontal top cross bar 102, respectively, at rounded L-shaped joints 120, 121. The L-shaped joints 120, 121 are also made of metal tubing.

The frame 100 also has horizontal bottom crossbar 104, made of metal tubing, having a left end 104*a* and a right end 104*b*. The horizontal bottom crossbar 104 is connected to the lower ends 106*b*, 108*b* of the left and right vertical supports 106, 108, respectively. The horizontal bottom crossbar 104 is connected to the vertical supports 106, 108 in a manner parallel to the top cross bar 102.

The frame 100 also has horizontal midsection crossbar 110, made of metal tubing, having a left end 110*a* and a right end 110*b*. The horizontal midsection crossbar 110 is connected to a midsection of the left and right vertical supports 106, 108, respectively, between the lower ends 106*b*, 108*b* of the left and right vertical supports 106, 108, respectively, and the upper ends 106*a*, 108*a* of the left and right vertical supports 106, 108, respectively. It is preferable that the horizontal midsection crossbar 110 be attached to the left and right vertical supports 106, 108, approximately halfway between the upper ends 106*a*, 108*a* and the lower ends 106*b*, 108*b*, of the left and right vertical supports 106, 108, respectively. The horizontal midsection crossbar 110 serves as the base of an upper frame 130 that supports a rebounding mat 200, and receives and secures the same by springs 210, a plurality of which are spaced at substantially similar intervals 209 apart from each other, and are attached between a bottom edge 200*a* of the rebounding mat 200 and the horizontal midsection crossbar 110. More specifically, the springs 210 are made from metal, similar to the springs in a trampoline, and include a first hook end 211 which is connected into to the rebounding mat 200 through a metal loop 212 which is sewn into the rebounding mat. They also include a second hook end 213, which is connected into the frame 100 through a hole 214 in the frame 100.

The springs 210 also continue at intervals between a left edge 200*b* of the rebounding mat 200 and the portion of the left vertical support 106 above the horizontal midsection crossbar 110, between a top edge 200*c* of the rebounding mat 200 and the horizontal top crossbar 102, and between a right edge 200*d* of the rebounding mat 200 and the portion of the right vertical support 108 above the horizontal midsection crossbar 110, in a manner that the rebounding mat 200 is, in general, evenly suspended across the portion of the frame 100 above the horizontal midsection crossbar 110, and is pulled or tensioned into the position shown in FIG. 1. The rebounding mat 200 will thus have the attribute of causing a thrown ball that contacts it to bounce back in the direction from which the ball was thrown with substantially the same force and velocity with which the ball was thrown. In other words, rebounding mat 200 has the attribute of translating the kinetic energy of a thrown ball at the initial impact of the ball with the rebounding mat 200 into a reflection of such.

The rebounding mat 200 may be made of various durable materials, but it is preferred that it be constructed of plastic similar to that used in the construction of conventional trampoline mats. The metal loops 212 are preferably made of the same metal as the springs 210. A different embodiment could include a plurality of ring and grommet fasteners to support the rebounding mat 200 at a tension that will cause the same elastic reflection of the kinetic energy of a thrown ball. The rebounding mat 200 is generally about thirty six inches wide and forty eight inches tall, and may also have some kind of decal or target zone painted or marked on its face.

The rebounding mat 200 also has an apron 244 sewn around its periphery which may be pulled across the springs 210, to provide a cover for them. A series of straps 245 extend out from the apron, which may be used to firmly place the apron 244 over the springs 210. This apron 244 protects the springs from wear caused by rust from rain, snow or other moisture caused by weather. The apron further has the effect of diminishing the number of dangerous ricochets that may occur from an aberrantly thrown ball.

The preferred embodiment further includes a ball stopping mat 300 that is made of a heavy material, preferably thick natural rubber that is of high quality and durability, that has relatively high friction to prevent slippage of a ball on contact. The ball stopping mat 300 hangs below the horizontal midsection crossbar 110 in a lower frame 140 section of the frame 100. The horizontal midsection crossbar 110 acts as the top of the lower frame 140.

The ball stopping mat 300 is attached to the horizontal midsection crossbar 110 by a series of fasteners 310, which may consist of a series of straps, clips, or bolts, for example plastic cable ties, or nylon or dyneema webbing. It is preferred that the fasteners 310 be straps made of nylon webbing, which will tend not to damage the ball stopping mat 300 upon the repeated impacts of balls over time. In this preferred embodiment, the ball stopping mat 300 is not attached to the left and right vertical supports 106, 108, and is also not attached to the horizontal bottom crossbar 104. The ball stopping mat 300 is allowed to hang flaccidly from the horizontal midsection horizontal crossbar 110, which facilitates the absorption of the kinetic energy of the thrown ball. The ball stopping mat 300 may alternatively be attached to all four sides of the lower frame 140, including the left and right vertical supports 106, 108, and the horizontal bottom crossbar 104. This is not preferred, however, because the ball stopping mat 300 will be subject to excess wear, and will likely experience tearing around the fasteners 310.

In the preferred embodiment, the ball stopping mat 300 has the approximate dimensions of thirty six inches in height and thirty six inches in width, and about one half of an inch thick. Moreover, the ball stopping mat 300 may be perforated with holes, preferably one inch in diameter, evenly spaced in a pattern, as long as the perforation does not substantially weaken the ability of the ball stopping mat 300 to withstand the repeated impacts of thrown balls.

The preferred embodiment also includes a strike zone 399 painted on the ball stopping mat 300, substantially in the center of the ball stopping mat 300 using a color which contrasts with the color of the ball stopping mat 300. The strike zone 399 is approximately twelve inches high and twelve inches in width.

The preferred embodiment has a frame brace member 150 which extends behind the frame 100 from a point above the horizontal midsection crossbar 110 to the ground at such an angle as to provide sufficient support to the ball training device. This may be an angle from fifteen degrees to approximately seventy degrees away from either the left and right vertical supports 106, 108. The frame brace member 150 is also preferably made from metal tubing, and consists of a left brace support 126 and a right brace support 128, with a horizontal brace bottom crossbar 124 extending between them. The horizontal brace bottom crossbar 124 makes contact with the ground simultaneously with the horizontal bottom crossbar 104, which in the preferred embodiment creates a compact footprint for the training device, allowing it to be utilized in a smaller space than would be required for two separate devices.

The frame 100 may alternatively have a unique pivot point along the axis of the horizontal midsection crossbar 110, which enables it to be folded substantially in half. This may be accomplished simply by attaching the ball stopping mat 300 pivotally to the horizontal midsection crossbar 110, and at the same time by creating points on the left and right vertical supports 106, 108 that will allow them to be disassembled at some point along their length which is near the horizontal midsection crossbar 110. This allows the training device for ball sports to be shipped more easily, and to be more transportable by the coach or player who may be using it in different locations at various times. For example, a coach may take it from home to a practice field where the trainees will use it. The foldability of the device will be desirable in this circumstance.

The frame 100, may also include a tilt adjustment mechanism 199 which allows the frame to be tilted at a less or more vertical angle, depending on the rebound angle that is desired for exercises utilizing the rebounding mat 200. The tilt adjustment mechanism 199, utilizes the same technology that is available in the prior art. It may incorporate a cotter pin with different possible placements upon which the frame brace member 150 may rest in a stable position, or may involve a clamp that may be tightened to fix the frame at the desired angle. Alternatively, it may incorporate any of the tilt adjustment mechanisms that are adaptable to the present invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A training device for ball sports comprising
a frame, which is substantially planar,
a rebound mat attached to the frame elastically,
for rebounding a ball that strikes the rebound mat, said rebound mat having a top edge and a bottom edge, and
a stop mat attached to the frame inelastically,
for stopping a ball that strikes the stop mat;
wherein said frame is of a rectangular shape and comprises a left vertical support, a right vertical support, a horizontal top crossbar, a horizontal bottom crossbar, a horizontal midsection crossbar attached to the left and right vertical supports and disposed between the horizontal top and bottom crossbars, and a back brace member for supporting said frame in an upright position;
and wherein said the top edge of the rebound mat is connected to said horizontal top crossbar by a plurality of elastic attachments and said bottom edge of the rebound mat is connected to said horizontal midsection crossbar by a plurality of elastic attachments.

2. The training device for ball sports as in claim 1 wherein the frame is constructed of metal tubing.

3. The training device for ball sports as in claim 1 wherein said elastic attachments comprise a series of metal springs, which are placed at substantially similar intervals around the periphery of the rebound mat, and
which pull the rebound mat to a tight, substantially flat position.

4. The training device for ball sports as in claim 3 wherein the stop mat is pivotally attached to the horizontal midsection crossbar for storage behind or adjacent to the rebound mat during shipment, allowing the possibility of folding the frame substantially in half for transport.

5. The training device for ball sports as in claim 1 wherein the rebound mat is suspended from the frame in a position above the stop mat.

6. The training device for ball sports as in claim 1 wherein the stop mat hangs flaccidly from the horizontal midsection crossbar.

7. The training device for ball sports as in claim 1 wherein the frame rests in a substantially upright position.

8. The training device for ball sports as in claim 5 wherein the stop mat is connected to the frame across all edges of the stop mat.

9. The training device for ball sports as in claim 1 wherein the stop mat comprises a perforated rubber mat,
with a strike zone marked in the center portion of the surface.

10. The training device for ball sports as in claim 9 wherein the strike zone is marked using a color that contrasts with the stop mat.

11. The training device for ball sports as in claim 3 wherein said series of metal springs are covered by an apron attached to a periphery of the rebound mat.

12. The training device for ball sports of claim 3 wherein said stop mat is made from an elastomeric material approximately an inch thick and approximately a square measuring three feet on any side, said stop mat being perforated with a pattern of holes approximately one inch in diameter.

13. The training device for ball sports of claim 3 wherein a strike zone is marked on the stop mat in a color that contrasts with the stop mat.

* * * * *